US007104903B1

(12) United States Patent
Chen

(10) Patent No.: US 7,104,903 B1
(45) Date of Patent: Sep. 12, 2006

(54) NET POST SUPPORTING DEVICE OF A PING-PONG TABLE

(75) Inventor: Ying-Tse Chen, Tainan Hsien (TW)

(73) Assignee: Pai Li Business Co., Ltd., Tainan Hsien (TW)

( * ) Notice: Subject to any disclaimer, the term of this patent is extended or adjusted under 35 U.S.C. 154(b) by 0 days.

(21) Appl. No.: 11/207,948

(22) Filed: Aug. 22, 2005

(51) Int. Cl.
*A63B 61/02* (2006.01)
*A63B 61/00* (2006.01)

(52) U.S. Cl. ..... 473/491; 473/492

(58) Field of Classification Search ..... 473/491–493
See application file for complete search history.

(56) References Cited

U.S. PATENT DOCUMENTS 2,150,033 A * 3/1939 Hillson ..... 473/491
2,206,955 A * 7/1940 Hillson ..... 473/491
2,470,318 A * 5/1949 Nadelson ..... 160/368.1
3,078,094 A * 2/1963 Goodenough ..... 473/491
4,850,590 A * 7/1989 Lin ..... 473/491

* cited by examiner

*Primary Examiner*—Raleigh W. Chiu
(74) *Attorney, Agent, or Firm*—Bacon & Thomas

(57) ABSTRACT

A net post-supporting device of a ping-pong table includes a net post and a bottom base composed of a lower plate and an upper plate. The lower plate is fixed with an upright threaded rod at an eccentric location, and the upper plate is bored with an insert hole for the threaded rod to be inserted therethrough. The net post positioned on the upper plate is shaped hollow and has its lower inner end formed with a threaded hole for the threaded rod to be screwed therethrough, letting the upper end of the threaded rod extending in the hollow interior of the net post. After the upper and the lower plate are respectively mounted on the upper and the lower side of the edge of the table, the net post is screwed tight to firmly fix the two plates sandwiching the edge of the table, convenient in handling and using.

2 Claims, 4 Drawing Sheets

NET POST SUPPORTING DEVICE OF A PING-PONG TABLE

BACKGROUND OF THE INVENTION

1. Field of the Invention

This invention relates to a net post-supporting device of a ping-pong-table, particularly to one able to firmly fix the net post on the edge of a ping-pong table, simple in structure and convenient in assembling and using.

2. Description of the Prior Art

As commonly known, two net posts of a ping-pong table are respectively assembled at the opposite ends of the centerline of the ping-pong table for a net to be fastened therebetween. A conventional device for fixing a net post on the edge of a ping-pong table includes a bottom base secured under the net post and cut with a notch, and a tightening bolt inserted upward through the underside of the bottom base. After the bottom base is positioned on the edge of the table through its notch, the tightening bolt is screwed upward from under the table to tightly push against the underside of the table and firmly fix the net post in position.

However, the conventional net post supporting device of a ping-pong table has to be additionally provided with a threaded bolt and, after screwed tight, the threaded bolt has its lower end protruding out of the underside of the table; therefore, a players legs may carelessly bump against the threaded bolt and get injured, increasing cost in components and lacking of safety.

SUMMARY OF THE INVENTION

The objective of the invention is to offer a net post supporting device of a ping-pong table, requiring comparatively few components and convenient in handling and using.

The net post-supporting device of a ping-pong table in the present invention includes a net post and a bottom base positioned under the net post and composed of a lower plate and an upper plate. The lower plate is fixed; thereon with an upright threaded rod at an eccentric location of its topside, and the upper plate is bored with an insert hole at an eccentric location for the threaded rod to be inserted therethrough. The net post is hollow shaped and has its lower inner end formed with a threaded hole for the threaded rod to be screwed therethrough, letting the upper end of the threaded rod extending in the hollow interior of the net post. After the upper and the lower plate are respectively mounted on the upper and the lower side of the edge of the table, the net post is screwed tight with the threaded rod of the lower plate to push the upper plate to move downward. Thus, the upper and the lower plate can be respectively and firmly positioned on the upper and the lower side of the edge of the table, and the net post can be supported stably for fastening a net therebetween, simple in structure and convenient in handling.

BRIEF DESCRIPTION OF DRAWINGS

This invention will be better understood by referring to the accompanying drawings, wherein.

DETAILED DESCRIPTION OF THE PREFERRED EMBOIDMENT

Figure 1:
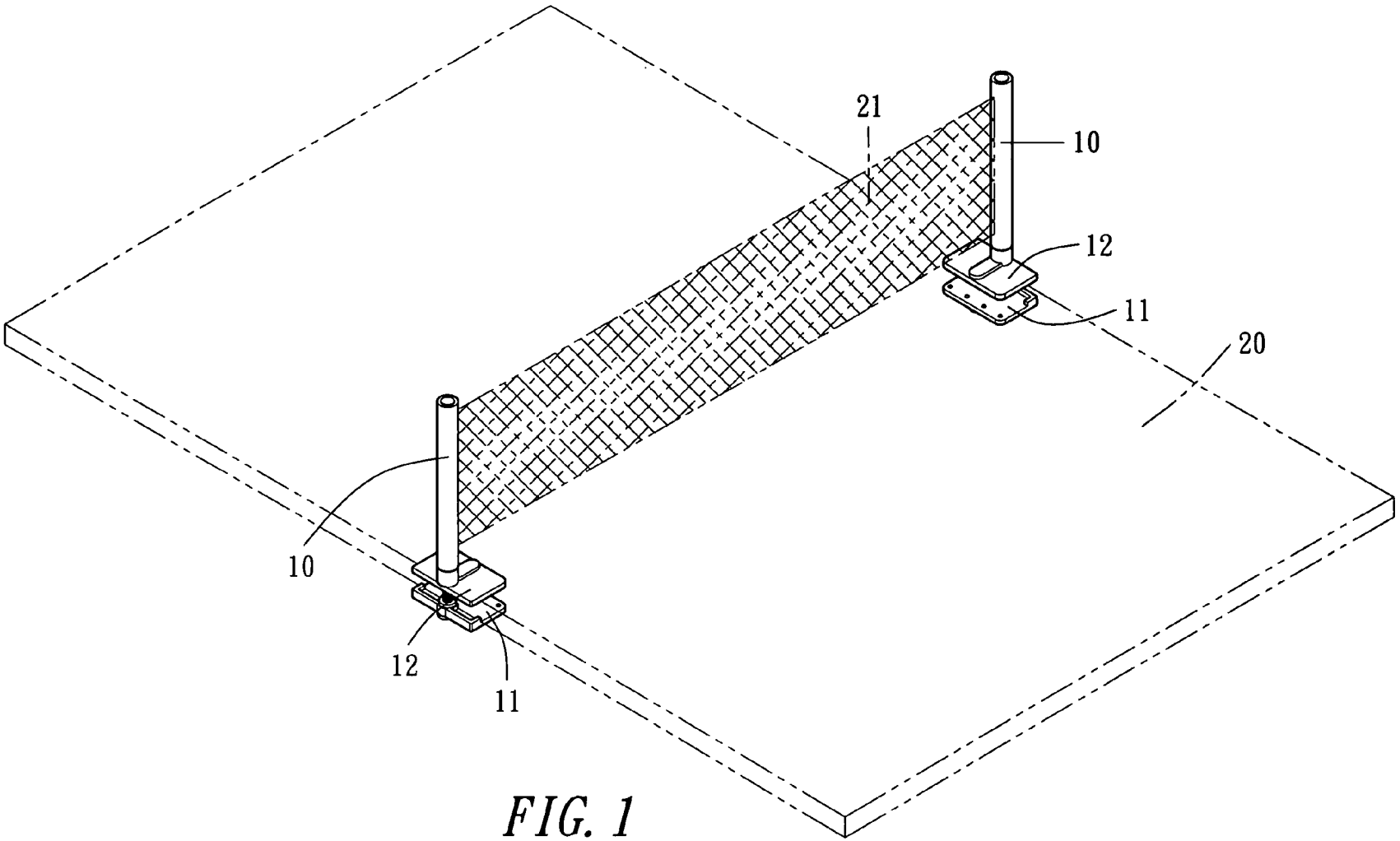
FIG. 1 is a perspective view of a net post-supporting device assembled on a ping-pong table in the present invention.
Figure 2:
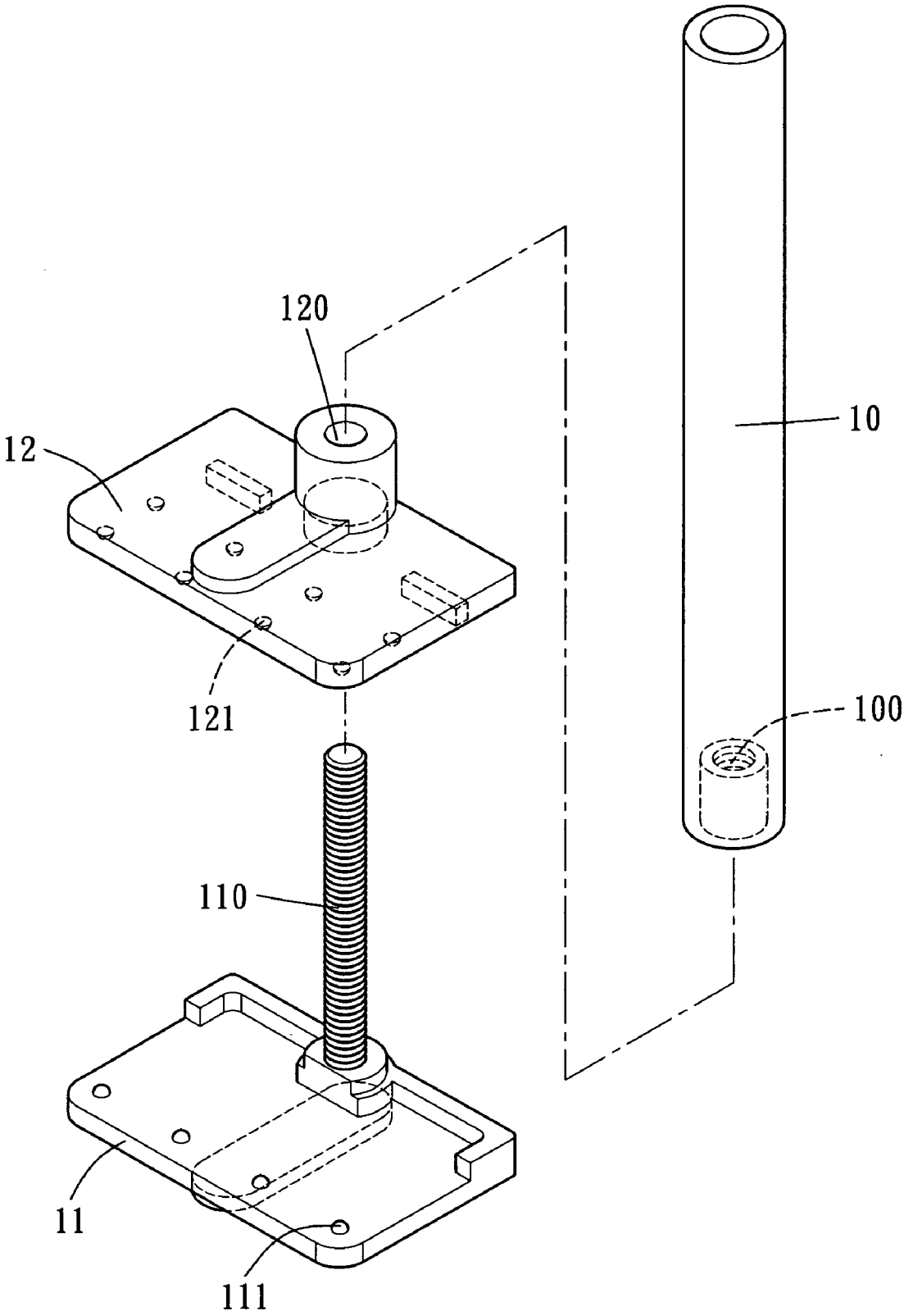
FIG. 2 is an exploded perspective view of the net post-supporting device of a ping-pong table in the present invention.

A preferred embodiment of a net post supporting device of a ping-pong table in the present invention, as shown in FIGS. 1 and 2, includes a bottom base composed of a lower plate 11 and an upper plate 12, and a net post 10 combined together.

The lower plate 11 is fixed thereon with an upright threaded rod 110 at an eccentric location of its topside, and the upper plate 12 is bored with an insert hole 120 (a non-threaded hole) at an eccentric location for the threaded rod 110 of the lower plate 11 to be inserted therethrough.

The net post 10 is hollow shaped and has its lower inner end formed with a threaded hole 100 for the threaded rod 110 to be screwed therethrough, with the upper end of the threaded rod 110 extending in the hollow interior of the net post 10. By so designing, a clamping space between the lower and the upper plate 11 and 12 can be formed by mutual combination of the lower plate 11, the upper plate 12 and the threaded rod 110, and by adjusting this clamping space, the lower and the upper plate 11, 12 to be firmly fixed on the edge of the table 20. In addition, the lower and the upper plate 11, 12 have their opposite surfaces respectively provided with a plurality of holding projection 111, 121 for reinforcing their holding force.

Figure 3:
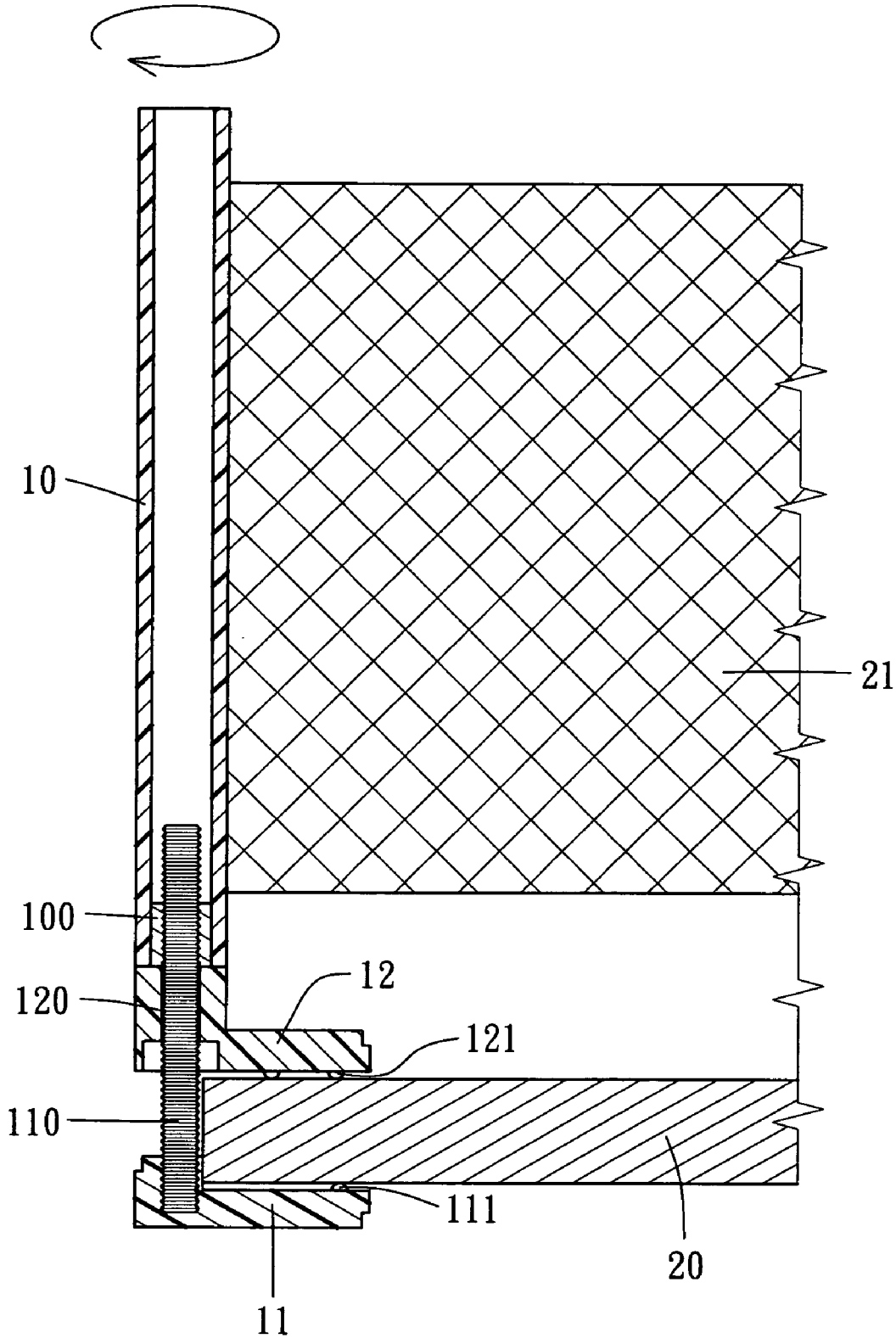
FIG. 3 is a cross-sectional view of the net post supporting device assembled on a ping-pong table in the present invention.

In assembling and using, firstly, the net post 10 is screwed with the threaded rod 110 to adjust the clamping space between the upper and the lower plate 12 and 11. Next, the upper and the lower plate 12, 11 are respectively mounted on the upper and the lower side of the edge of the table 20, and then the net post 10 is screwed tight to have its lower end forcefully pushing the upper plate 12 to move downward and, in cooperation with the lower plate 11, tightly clamp the edge of the table 20 and firmly position the net post 10 on the edge of the table 20, as shown in FIG. 3.

Figure 4:
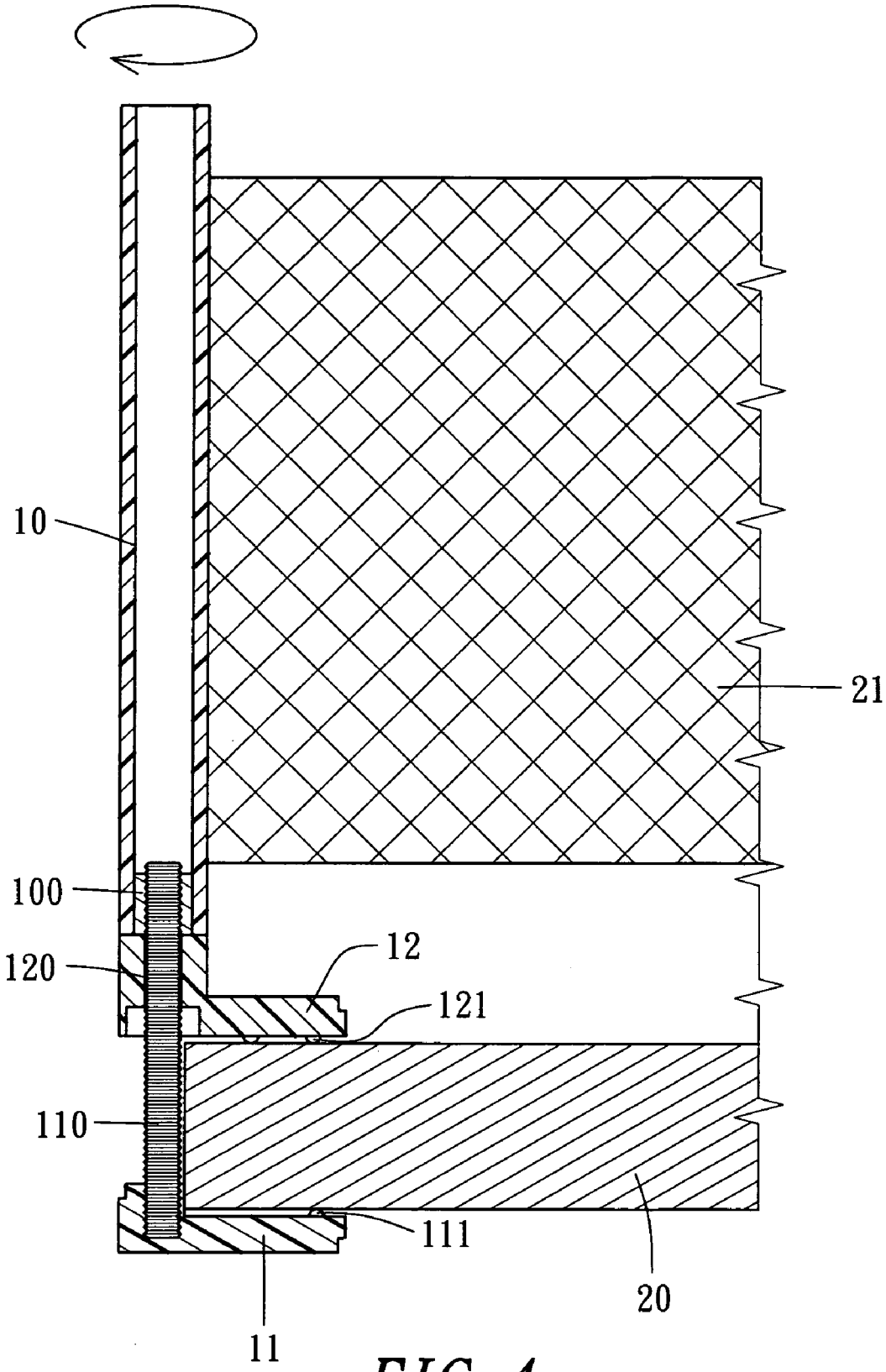
FIG. 4 is a cross-sectional view of the net post-supporting device assembled on a comparatively thick ping-pong table in the present invention.

In addition, the clamping space between the upper and the lower plate 12, 11 can be adjusted in height for matching with different-thick ping-pong tables 20, as shown in FIG. 4, and the upper and the lower plate 12, 11 can be firmly fixed on the table 20 only by screwing tight the net post 10, convenient in handling and using, requiring comparatively few components and elevating its practicability.

While the preferred embodiment of the invention has been described above, it will be recognized and understood that various modifications may be made therein and the appended claims are intended to cover all such modifications that may fall within the spirit and scope of the invention.

I claim:

1. A net post supporting device of a ping-pong table comprising a hollow net post and a bottom base, said bottom base positioned under said net post, said bottom base composed of a lower plate and an upper plate, said lower plate fixed thereon with an upright threaded rod at an eccentric location of its topside, said upper plate bored with an insert hole for said threaded rod to be inserted therethrough, said net post having its lower inner end formed with a threaded hole, said threaded rod of said lower plate screwed through said threaded hole of said upper plate, said threaded rod having its upper end extending in the hollow interior of said net post.

2. The net post supporting device of a ping-pong table as claimed in claim 1, wherein said lower plate and said upper plate have their opposite surfaces respectively provided with a plurality of holding projections to reinforce the holding force of the two plates for tightly clamping the edge of a ping-pong table.

* * * * *